US011161720B2

(12) United States Patent
Wang et al.

(10) Patent No.: US 11,161,720 B2
(45) Date of Patent: Nov. 2, 2021

(54) LIFTING DEVICE FOR LIFTING A SEMI-PRECAST BEAM AND LIFTING METHOD USING THE SAME

(71) Applicant: RUENTEX ENGINEERING & CONSTRUCTION CO., LTD., Taipei (TW)

(72) Inventors: Jui-Chen Wang, Taipei (TW); Shao Kuo Lu, Taipei (TW); Kuen-Lung Chang, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 0 days.

(21) Appl. No.: 16/855,615

(22) Filed: Apr. 22, 2020

(65) Prior Publication Data

US 2021/0107773 A1 Apr. 15, 2021

(30) Foreign Application Priority Data

Oct. 15, 2019 (TW) ..... 108137049

(51) Int. Cl.
*B66C 1/66* (2006.01)
*E04G 21/14* (2006.01)
*E04C 3/20* (2006.01)

(52) U.S. Cl.
CPC ..... *B66C 1/66* (2013.01); *E04G 21/142* (2013.01); *E04C 3/20* (2013.01)

(58) Field of Classification Search
CPC ..... E04G 21/142; E04C 3/20
USPC .... 294/67.1, 67.5, 81.3, 89; 52/125.1, 125.2
See application file for complete search history.

(56) References Cited

U.S. PATENT DOCUMENTS 718,506 A * 1/1908 Normandin
1,536,643 A * 5/1925 Williams ..... B66C 1/10 294/67.1
2,905,501 A * 9/1959 Jakubowski ..... B66C 1/10 294/81.3
4,018,470 A * 4/1977 Tye ..... B66C 1/666 294/89
4,079,983 A * 3/1978 Van Mastrigt ..... B66C 1/66 294/89
5,857,296 A * 1/1999 Niday ..... E04G 21/142 52/125.1
7,393,033 B1 * 7/2008 Bisso, IV ..... F16G 15/06 294/82.1
10,188,899 B1 * 1/2019 Acuna, Jr. ..... A63B 23/0405
(Continued)

*Primary Examiner* — Paul T Chin
(74) *Attorney, Agent, or Firm* — Juan Carlos A. Marquez; Marquez IP Law Office, PLLC

(57) ABSTRACT

A lifting device comprises a main body, a clasping assembly, a first shaft and a second shaft. The main body comprises a first through hole, a second through hole and a third through hole therein. The clasping assembly comprises a closed-loop structure configured to be engaged with the third through hole. The first shaft is adapted to be inserted into the first through hole of the main body, and the second shaft is adapted to be inserted into the second through hole of the main body. The main body comprises positioning slots therein and the first and the second shafts have positioning elements thereon. The positioning slots collaborate with the positioning elements to prevent the first and the second shafts from falling out of the first and the second through holes of the main body.

11 Claims, 14 Drawing Sheets

(56) References Cited

U.S. PATENT DOCUMENTS

| | | | | |
|---|---|---|---|---|
| 2012/0025552 | A1* | 2/2012 | Echarri Latasa | B66C 1/62 294/67.31 |
| 2013/0199110 | A1* | 8/2013 | Sias | B66C 1/62 52/125.2 |
| 2015/0016939 | A1* | 1/2015 | Moeller | B66C 1/108 414/800 |
| 2019/0282847 | A1* | 9/2019 | Acuna, Jr. | A63B 21/0004 |
| 2019/0352142 | A1* | 11/2019 | Carter | B66C 1/10 |

* cited by examiner

LIFTING DEVICE FOR LIFTING A SEMI-PRECAST BEAM AND LIFTING METHOD USING THE SAME

TECHNICAL FIELD

The present disclosure relates to a lifting device and a lifting method using the same, and more particularly to a lifting device and a lifting method for lifting a semi-precast beam.

BACKGROUND

In a conventional method for lifting a semi-precast beam, connectors are pre-embedded in the top of the solidified semi-precast beam such that a crane can be used to lift the semi-precast beam by hooking the pre-embedded connectors to a hook of the crane. However, once the upper section of the semi-precast beam at a later stage is filled with concrete to form a complete beam, since the connectors are pre-embedded in the top of the semi-precast beam, the pre-embedded connectors are permanently buried and cannot be reused. Thus, such conventional method is costly. Another conventional method for lifting a semi-precast beam is directly hooking and lifting the exposed stirrups of the beam through the hook of a crane, which, however, may cause deformation of the stirrups and the hook of the crane may be easily detached from the stirrups. Under such circumstance, the semi-precast beam may fall during operation and creates safety issues. Given the above, there is a need in the field to develop a lifting device that can be repeatedly used and the stirrups of semi-precast beams are not easily deformed during the process of lifting the beams.

SUMMARY OF INVENTION

According to one exemplary embodiment of the instant disclosure, a lifting device is used for lifting a semi-precast beam. The semi-precast beam has a plurality of loop-shaped stirrups with a predetermined distance therebetween or a spiral-shaped stirrup disposed along the lengthwise direction of the semi-precast beam. The lifting device comprises a main body, a clasping assembly, a first shaft and a second shaft. The main body comprises a first through hole, a second through hole and a third through hole therein, wherein an axis passes through the third through hole, and the first through hole and the second through hole are symmetrically arranged with respect to the axis. The clasping assembly comprises a closed-loop structure configured to be engaged with the third through hole. The first shaft is adapted to be inserted into the first through hole of the main body. The second shaft is adapted to be inserted into the second through hole of the main body. Where the lifting device is in use, the first shaft and the second shaft abut against inner surfaces of at least some of the plurality of loop-shaped stirrups or inner surfaces of the spiral-shaped stirrup of the semi-precast beam.

According to another exemplary embodiment of the instant disclosure, a lifting device comprises a main body, a clasping assembly, a first shaft and a second shaft. The main body comprises a first arm and a second arm extending outward from an axis. The first arm has a first through hole therein, and the second arm has a second through hole therein. The main body further comprises a third through hole therein, wherein the axis passes through the third through hole, and the first through hole and the second through hole are symmetrically arranged with respect to the axis. The clasping assembly comprises a closed-loop structure configured to be engaged with the third through hole. The first shaft is adapted to be inserted into the first through hole of the main body. The second shaft is adapted to be inserted into the second through hole of the main body.

According to another exemplary embodiment of the instant disclosure, a lifting method comprises the following steps: providing a semi-precast beam having a plurality of loop-shaped stirrups with a predetermined distance therebetween or a spiral-shaped stirrup disposed along the lengthwise direction of the semi-precast beam; providing a lifting device; moving the lifting device near the exposed portion of the stirrups such that the first through hole and the second through hole of the main body are slightly lower than the tops of the stirrups; providing the first shaft in the first through hole of the main body and the second shaft in the second through hole of the main body such that the first shaft and the second shaft are within the stirrups; and lifting the device such that the circumferences of the first shaft and the second shaft abut against inner surfaces of at least some of the stirrups.

BRIEF DESCRIPTION OF THE DRAWINGS

The present disclosure as well as a preferred mode of use, further objectives, and advantages thereof will be best understood by referring to the following detailed description of illustrative embodiments in conjunction with the accompanying drawings, wherein.

DETAILED DESCRIPTION

Figure 1A:
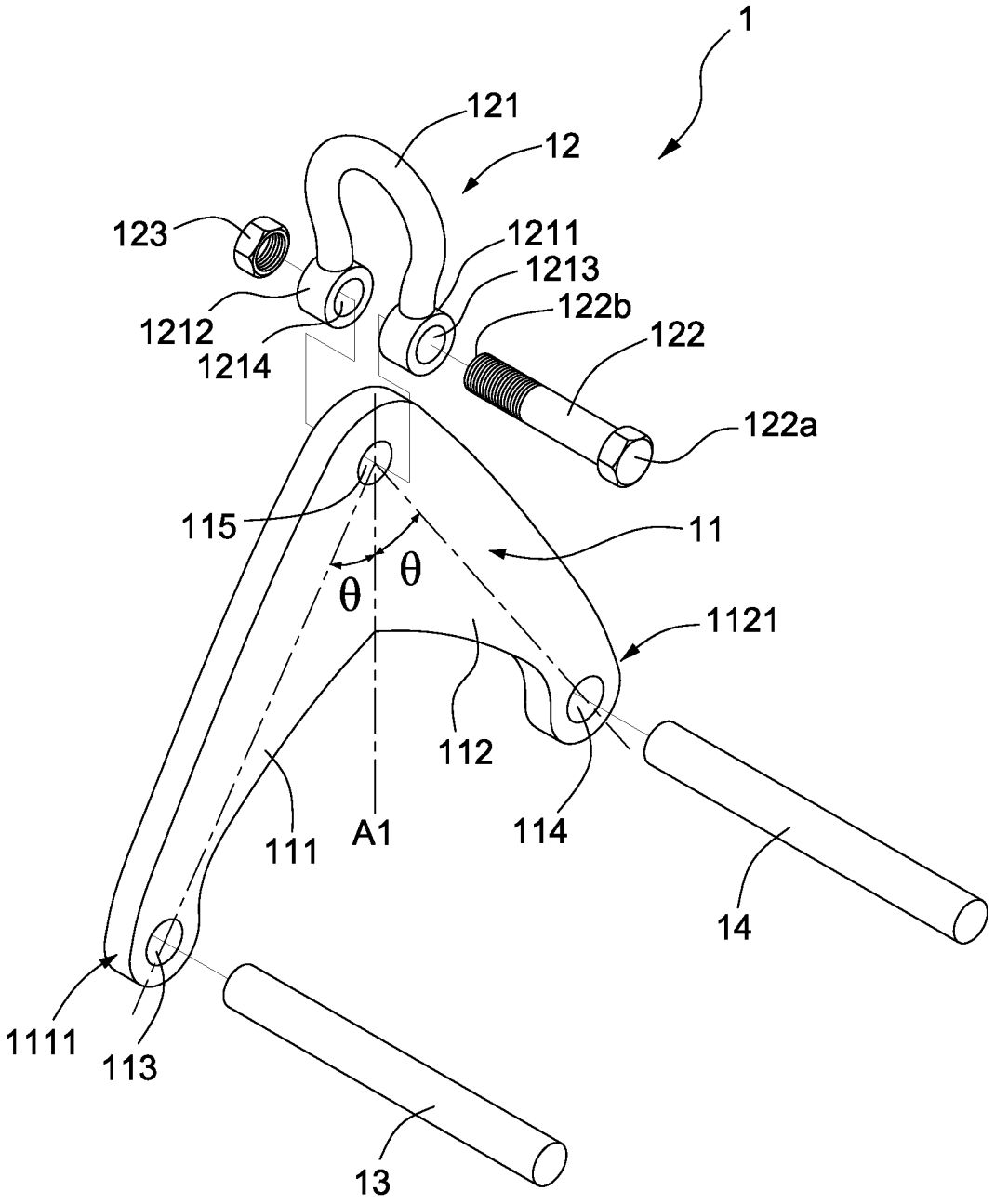
FIG. 1A is an exposed view showing a lifting device in accordance with the first embodiment of the instant disclosure.

The characteristics, subject matter, advantages, and effects of the present disclosure are detailed hereinafter by reference to embodiments of the present disclosure and the accompanying drawings. It is understood that the drawings referred to in the following description are intended only for purposes of illustration, and do not necessarily show the actual proportion and precise arrangement of the embodiments. Therefore, the proportion and arrangement shown in the drawings should not be construed as limiting or restricting the scope of the present disclosure.

Figure 1B:
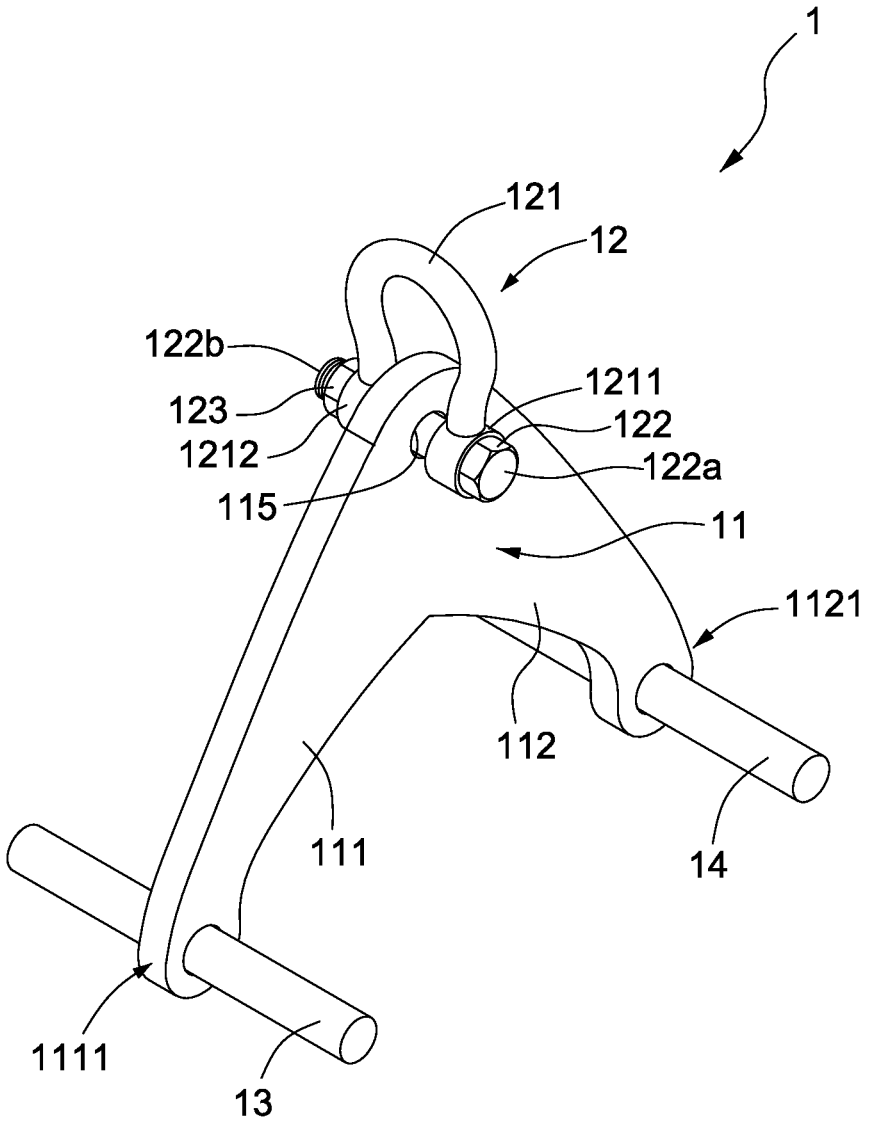
FIG. 1B is a schematic view showing the lifting device in FIG. 1A after being assembled.

Referring to FIGS. 1A and 1B, FIG. 1A is an exposed view showing a lifting device 1 in accordance with the first embodiment of the instant disclosure. FIG. 1B is a schematic view showing the lifting device 1 in FIG. 1A after being assembled. The lifting device 1 comprises a main body 11, a clasping assembly 12, a first shaft 13 and a second shaft 14. The main body 11 comprises a first arm 111 and a second arm 112 extending outward from an axis A1. In an embodiment of the instant disclosure, the first arm 111 is integrally formed with the second arm 112. In an embodiment of the instant disclosure, the first arm 111 and the second arm 112 each forms an angle θ with the axis A1 in a range of 30 degrees to 60 degrees. In the embodiment of the instant disclosure shown in FIGS. 1A and 1B, the first arm 111 and the second arm 112 extend outward and downward and each forms an angle 45 degrees with the axis A1. A first through hole 113 and a second through hole 114 of the main body 11 are disposed in distal ends 1111, 1121 of the first arm 111 and the second arm 112, respectively. As shown in FIG. 1A, in operation, the first through hole 113 and the second through hole 114 of the main body 1 are substantially disposed at the same height and lower than a third through hole 115 of the main body 11. The main body 1 is symmetrically arranged with respect to the axis A1 so that in operation the axis A1 passes through the third hole 115 in a vertical direction. Further, the first through hole 113 and the second through hole 114 of the main body 11 are symmetrically arranged with respect to the axis A1. The clasping assembly 12 comprises a closed-loop structure configured to be engaged with the third hole 115. The clasping assembly 12 comprises a generally U-shaped buckle 121 with two ends 1211, 1212 and a supporting shaft 122. The supporting shaft 122 is adapted to be disposed in through holes 1213, 1214 provided in two ends 1211, 1212 of the buckle 121. The free end of the supporting shaft 122 is fastened by fastener 123 (e.g., nut) so that the supporting shaft 122 can be rotatably disposed in the third through hole 115 of the main body 11. The diameter of the first end 122*a* of the supporting shaft 122 is slightly larger than that of the through hole 1213, and the diameter of the second end 122*b* of the supporting shaft 122 is smaller than that of the through holes 1213, 1214. The second end 122*b* of the supporting shaft 122 has threads for being engaged with the fastener 123. During the process of assembling the lifting device 1, the second end 122*b* is passed through the through holes 1213, 1214 and the fastener 123 is threadly engaged with the threads of the second end 122*b*. The cross section of the first shaft 13 and the second shaft 14 corresponds to the first holes 113 the second holes 114 of the main body 11. In an embodiment of the instant disclosure, the first shaft 13 and the second shaft 14 are of a cylindrical structure. In another embodiment of the instant disclosure, the first shaft 13 and the second shaft 14 are of a polygonal column structure, such as in the shape of a triangular column or a quadrangular column.

Figure 2A:
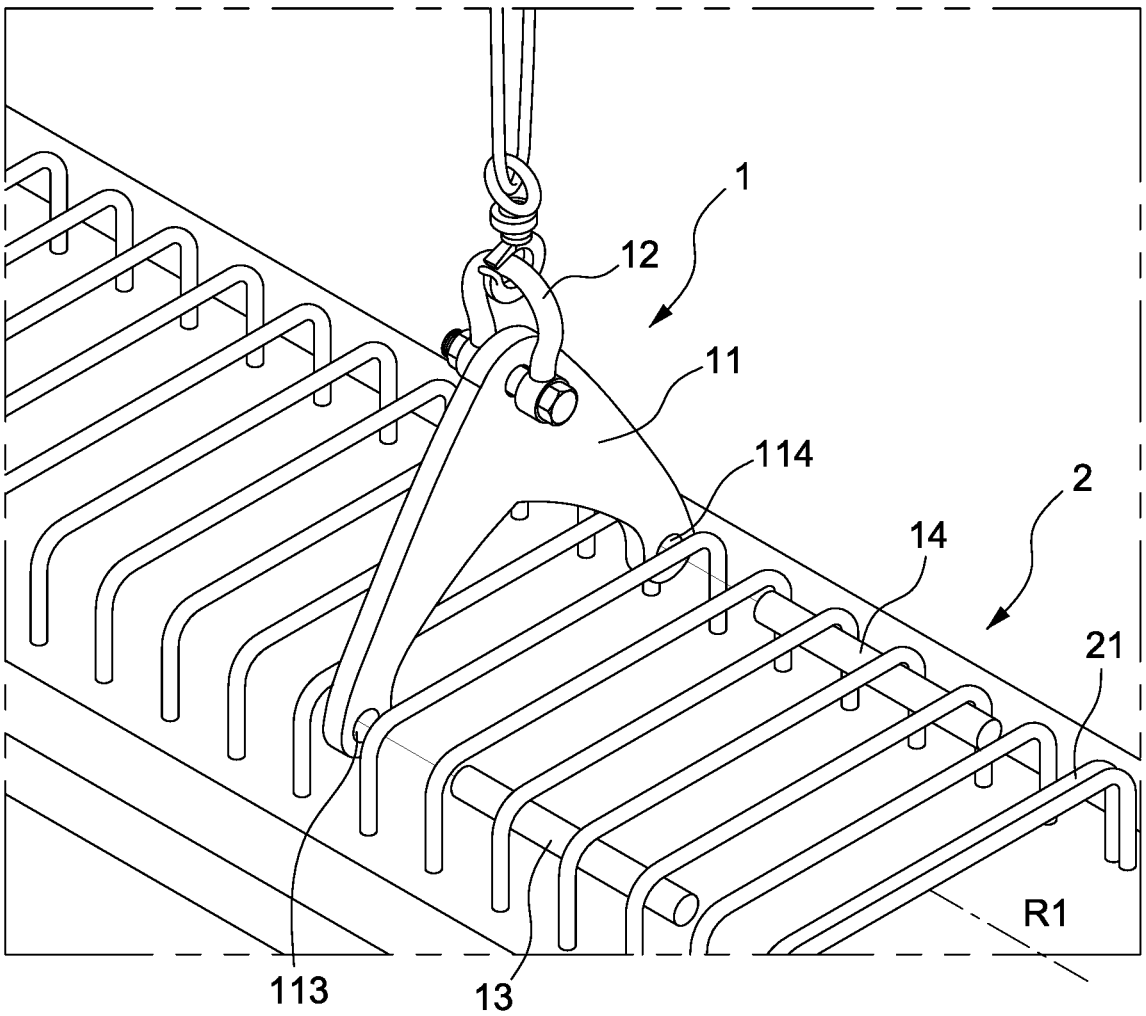
FIG. 2A is a schematic view showing a semi-precast beam lifted by the lifting device in accordance with the first embodiment of the instant disclosure.
Figure 2B:
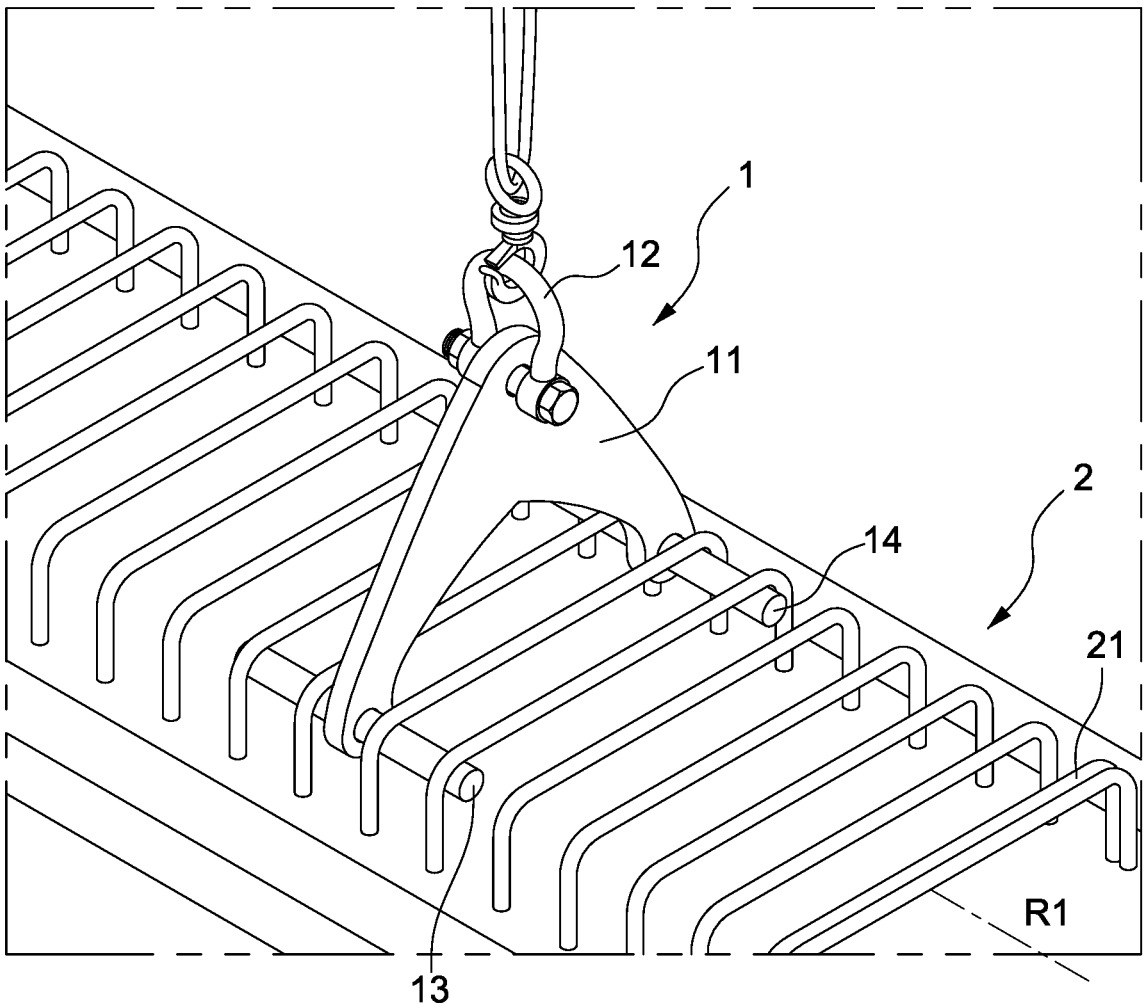
FIG. 2B is another schematic view showing the semi-precast beam lifted by the lifting device in accordance with the first embodiment of the instant disclosure.
Figure 3:
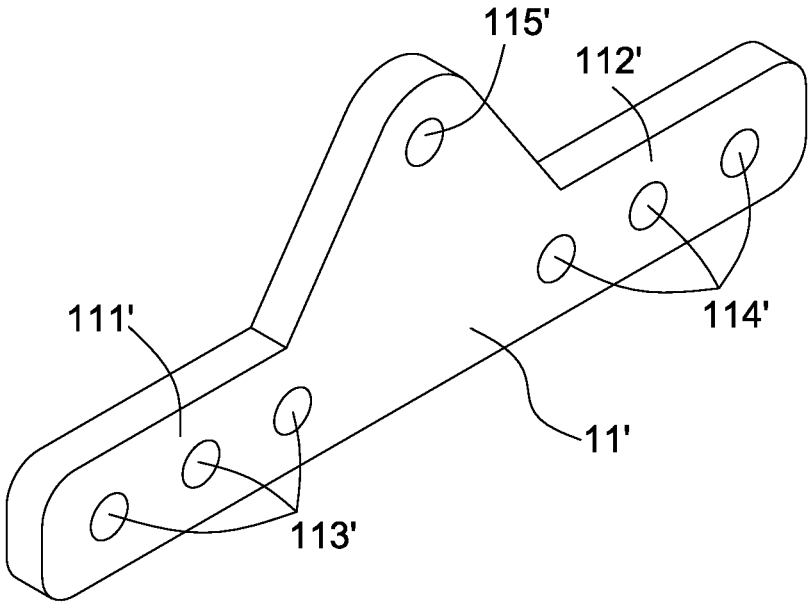
FIG. 3 is a schematic view showing a main body of the lifting device with a plurality of first and second through holes in accordance with the second embodiment of the instant disclosure.

FIGS. 2A and 2B show the method of lifting a semi-precast beam lifted by the lifting device 1 in accordance with the first embodiment of the instant disclosure. The lifting method comprises the following steps (a)-(c). In step (a), as shown in FIG. 2A, the clasping assembly 12 is engaged with the main body 11. In step (b), as shown in FIG. 2A, the U-shaped buckle 12 is lifted so that the main body 11 is moved above the exposed portion of the stirrups 21. The main body 11 is moved to a position where the first through hole 113 and the second through hole 114 of the main body 11 are slightly lower than the tops of the stirrups 21. In step (c), as shown in FIG. 2B, the first shaft 13 and the second shaft 14 are provided and are inserted into the first through hole 113 and the second through hole 114 of the main body 11, respectively, such that the first shaft 13 and the second shaft 14 abut against the inner surfaces near the corners of the exposed sections of the stirrups 21 of the semi-precast beam 2 to support the stirrups 21. In an embodiment of the instant disclosure, the semi-precast beam 2 comprises a plurality of loop-shaped stirrups 21 with a predetermined distance along the lengthwise direction R1 of the semi-precast beam 2. In another embodiment of the instant disclosure, the semi-precast beam 2 comprises a continuous spiral-shaped stirrup or other continuous stirrups of different shapes.

FIGS. 3 and 4A-4C show the lifting device 1' in accordance with the second embodiment of the instant disclosure. The main body 11' comprises a plurality of first through holes 113' and second through holes 114' in a linear arrangement. With such arrangement, the lifting device 1' can be used in different semi-precast beams 2 of different sizes, especially used in semi-precast beams 2 with different widths. The first arm 111' of the main body 11' comprises a plurality of first through holes 113' for selectively receiving the first shaft 13. The second arm 112' of the main body 11' comprises a plurality of second through holes 114' for selectively receiving the second shaft 14. The first arm 111' and the second arm 112' extend outward horizontally from the lengthwise center of the main body 11' such that the plurality of first through holes 113' are aligned with the plurality of second through holes 114' but are not aligned with the third through hole 115'. In the embodiment of the instant disclosure shown in FIG. 3, in operation, the plurality of first through holes 113' and the plurality of second through holes 114' are substantially disposed at the same height and lower than the third through hole 115'.

Figure 4A:
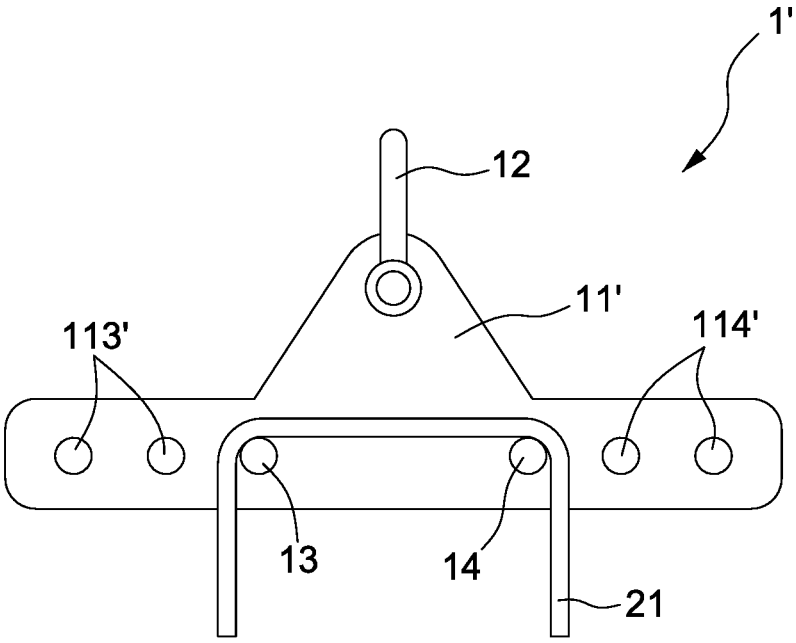
FIG. 4A is a schematic view showing a state in which shafts are inserted into the inner through holes in accordance with the second embodiment of the instant disclosure.
Figure 4B:
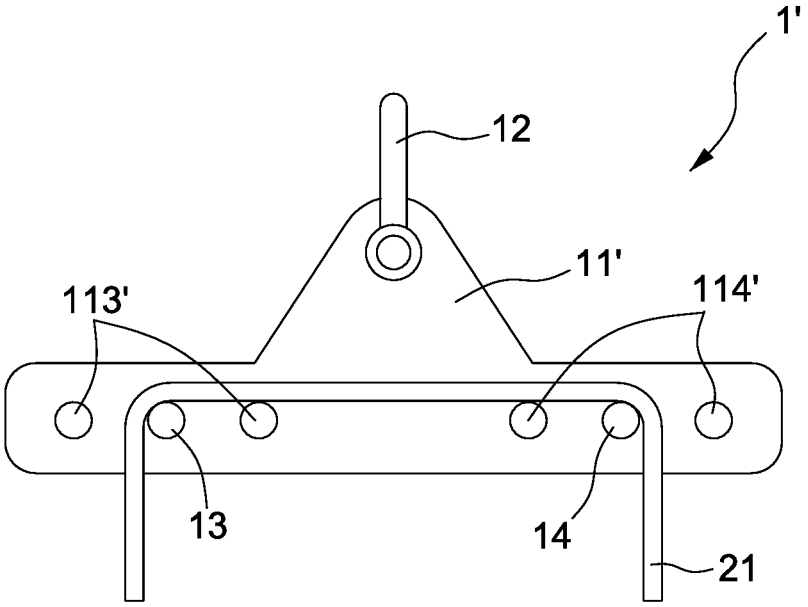
FIG. 4B is a schematic view showing a state in which the shafts are inserted into the middle through holes in accordance with the second embodiment of the instant disclosure.
Figure 4C:
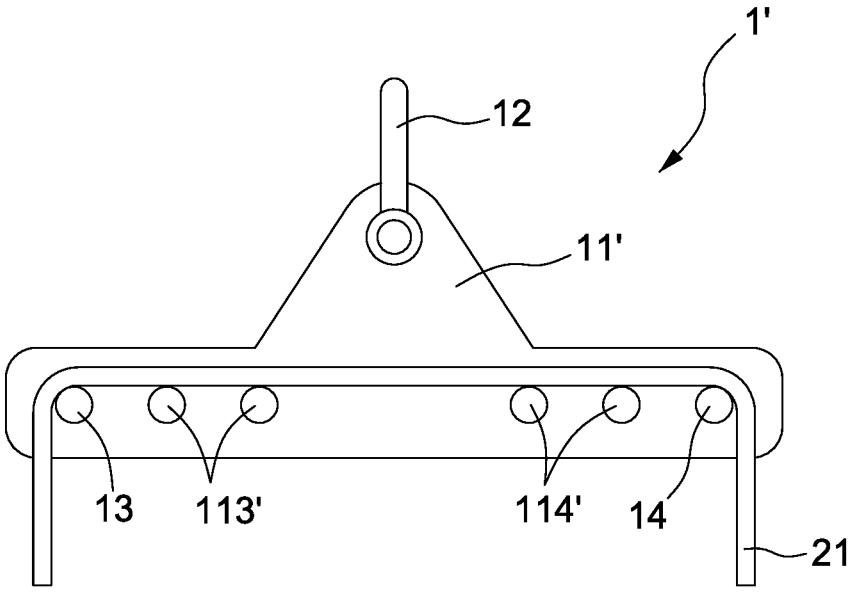
FIG. 4C is a schematic view showing a state in which the shafts are inserted into the outer through holes in accordance with the second embodiment of the instant disclosure.

In this embodiment of the instant disclosure, the steps (a')-(c') of lifting the semi-precast beam 2 by using the lifting device 1' are substantially the same as the previous embodiment. Specifically steps (a') and (b') are similar to step (a) and step (b). Step (c') relates to depending on the width of the stirrups 21 of the semi-precast beam 2, selectively receiving the first shaft 13 and second shaft 14 in one of first through holes 113' and one of second through holes 114' such that the first shaft 13 and second shaft 14 abut against the inner surfaces near the corners of the stirrups 21 of the semi-precast beam 2. The selected first through holes 113' and the selected second through holes 114' are symmetrical with respect to the lengthwise center of the main body 11'. As shown in FIG. 4A, the first shaft 13 and the second shaft 14 are inserted into the inner first through hole 113' and the inner second through hole 114', respectively. As shown in FIG. 4B, the first shaft 13 and the second shaft 14 are inserted into the middle first through hole 113' and the middle second through hole 114', respectively. As shown in FIG. 4C, the first shaft 13 and the second shaft 14 are inserted into the outer first through hole 113' and the outer second through hole 114', respectively.

Figure 5A:
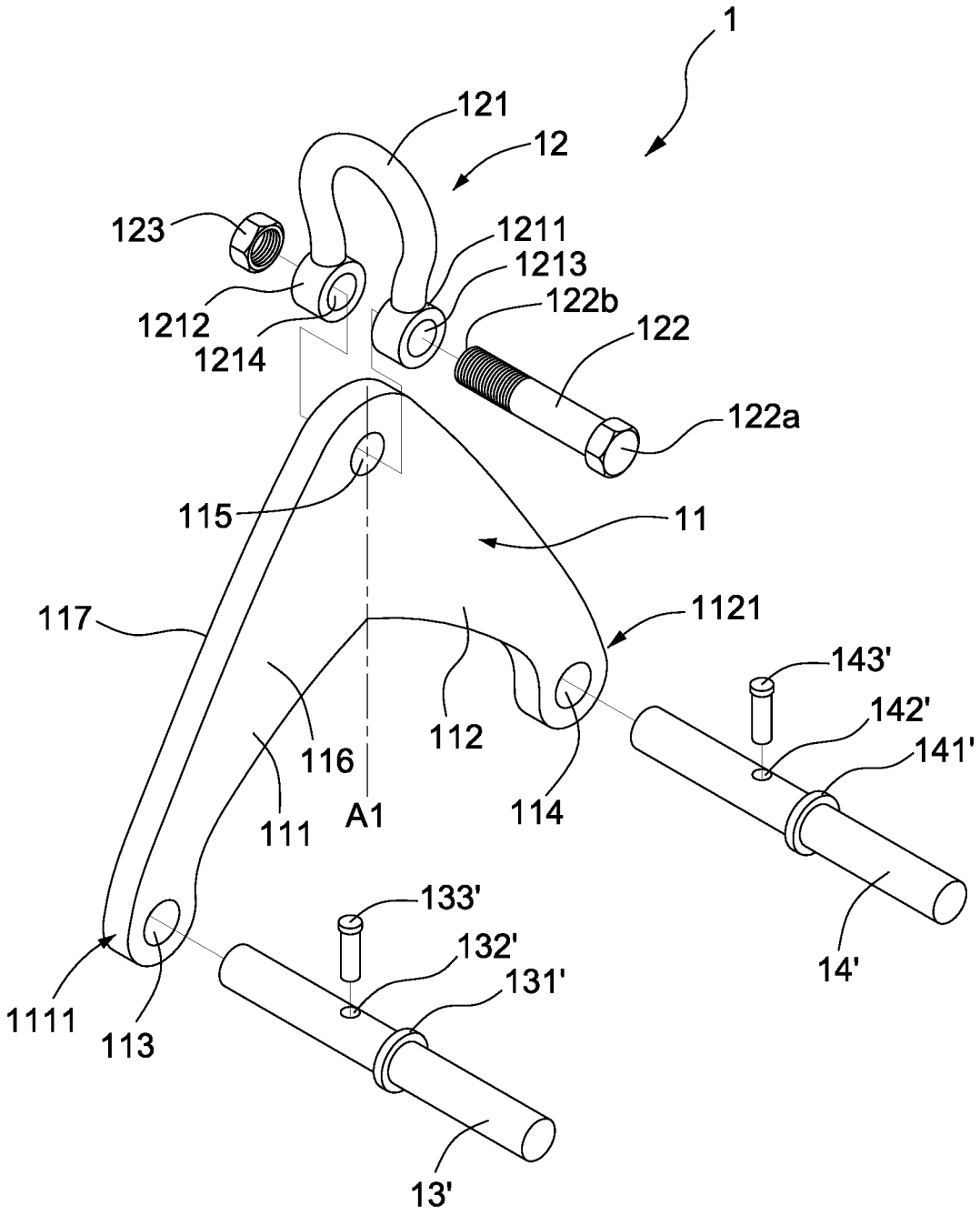
FIG. 5A is an exposed view showing a lifting device in accordance with the third embodiment of the instant disclosure.
Figure 5B:
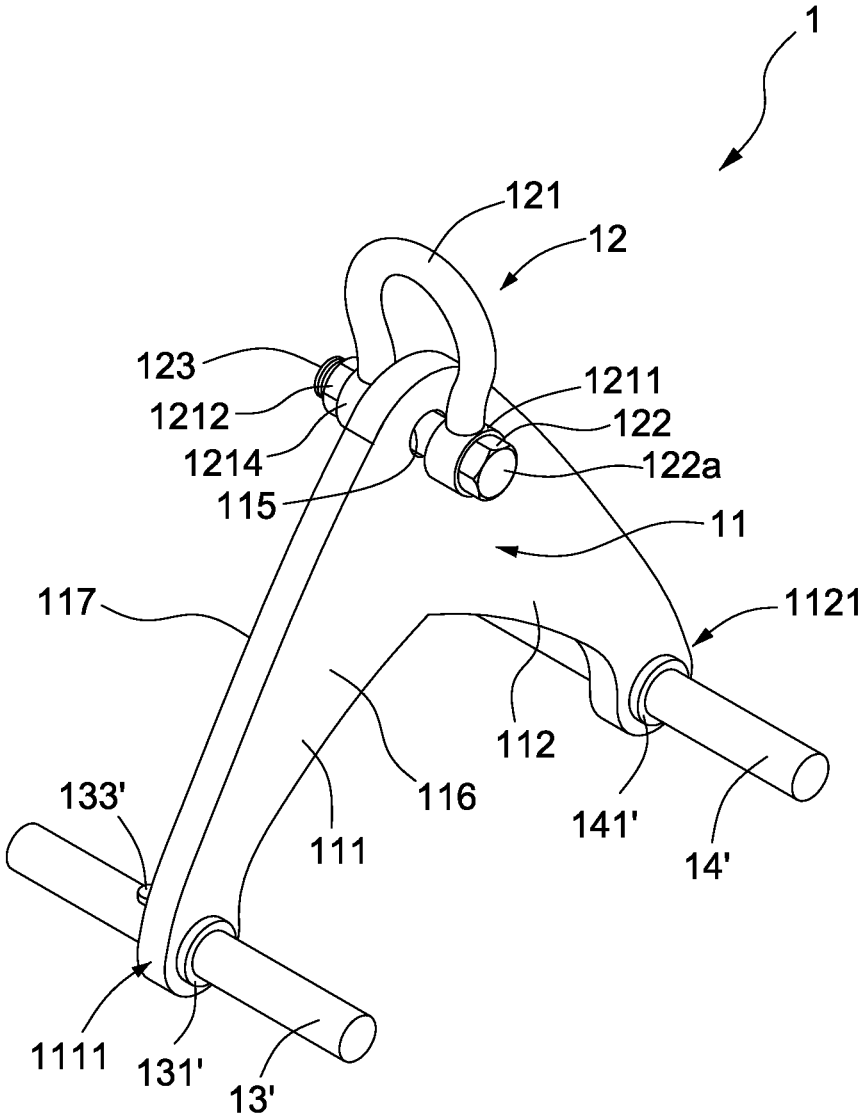
FIG. 5B is a schematic view showing the lifting device in FIG. 5A after being assembled.

To prevent the shaft 122 from sliding apart from the buckle 121 after being inserted into the through holes 1213, 1214, in the third embodiment of the instant disclosure shown in FIGS. 5A and 5B, the first shaft 13' comprises a first stop 131' thereon, a first pin hole 132' therein, and a first pin 133' adapted to be disposed in the first pin hole 132'. Further, the second shaft 14' comprises a second stop 141' thereon, a second pin hole 142' therein, and a second pin 143' adapted to be disposed in the second pin hole 142'. In an embodiment of the instant disclosure, the first stop 131' and the second stop 141' are ring-shaped structures and surround the circumferences of the first shaft 13' and the second shaft 14, respectively, and their outer diameters are larger than the first through hole 113 and the second through hole 114 of the main body 11. Moreover, in a lifting method wherein the lifting device 1 shown in FIGS. 5A and 5B is used, in step (c) of the method, when providing the first shaft 13' in the first through hole 113 of the main body 11 and the second shaft 14' in the second through hole 114 of the main body 11, as illustrated in FIGS. 5A and 5B, the first shaft 13' is inserted into the first through hole 113 such that the first stop 131' of the first shaft 13' abuts against the surface of a first side 116 of the main body 11, the first pin hole 132' of the first shaft 13' is located at a second side 117 of the main body 11, and the first pin 133' is disposed in the first pin hole 132' to prevent the first shaft 13' from sliding off from the first through hole 113. Likewise, the second shaft 14' is inserted into the second through hole 114 such that the second stop 141' of the second shaft 14' abuts against the surface of a first side 116 of the main body 11, the second pin hole 142' of the second shaft 14' is located at a second side 117 of the main body 11, and the second pin 143' is disposed in the second pin hole 142' to prevent the second shaft 14' from sliding off from the second through hole 114. The first side 116 is opposite the second side 117 of the main body 11.

In the fourth embodiment of the instant disclosure shown in FIGS. 6A-6F, the first shaft 13" comprises a first stop 131" thereon, a first positioning element 134" thereon and a third positioning element 135" thereon, wherein the first positioning element 134" is not aligned with the third positioning element 135' along the axial direction R2 of the first shaft 13". The second shaft 14" comprises a second stop 141" thereon, a second positioning element 144" thereon and a fourth positioning element 145" thereon, wherein the second positioning element 144" is not aligned with the fourth positioning element 145' along the axial direction R2 of the second shaft 14". The first positioning element 134" is spaced apart from the third positioning element 135" along the axial direction R2 by a predetermined distance. Furthermore, the first positioning element 134" is spaced apart from the third positioning element 135" along the circumferential direction by a quarter of a circle. Similarly, the second positioning element 144' is spaced apart from the fourth positioning element 145" along the axial direction R2 by the predetermined distance and the second positioning element 144' is spaced apart from the fourth positioning element 145" along the circumferential direction by a quarter of a circle. The main body 11" has a first positioning slot 1131" therein for allowing the first positioning element 134" and the third positioning element 135" of the first shaft 13" to pass through, and a second positioning slot 1141" therein for allowing the second positioning element 144" and the fourth positioning element 145" of the second shaft 14" to pass through.

Figure 6A:
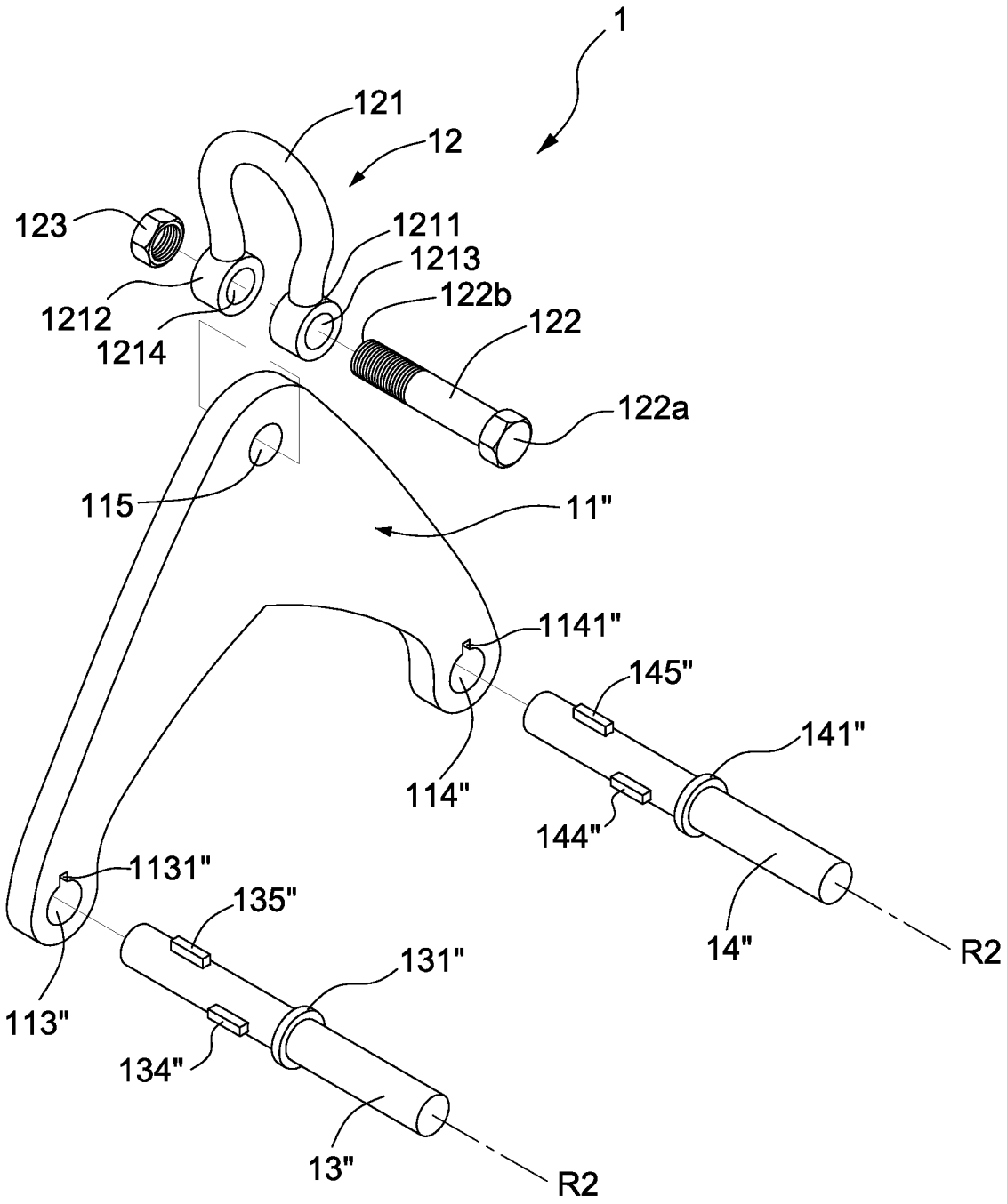
FIG. 6A is an exposed view showing a lifting device in accordance with the fourth embodiment of the instant disclosure.
Figure 6B:
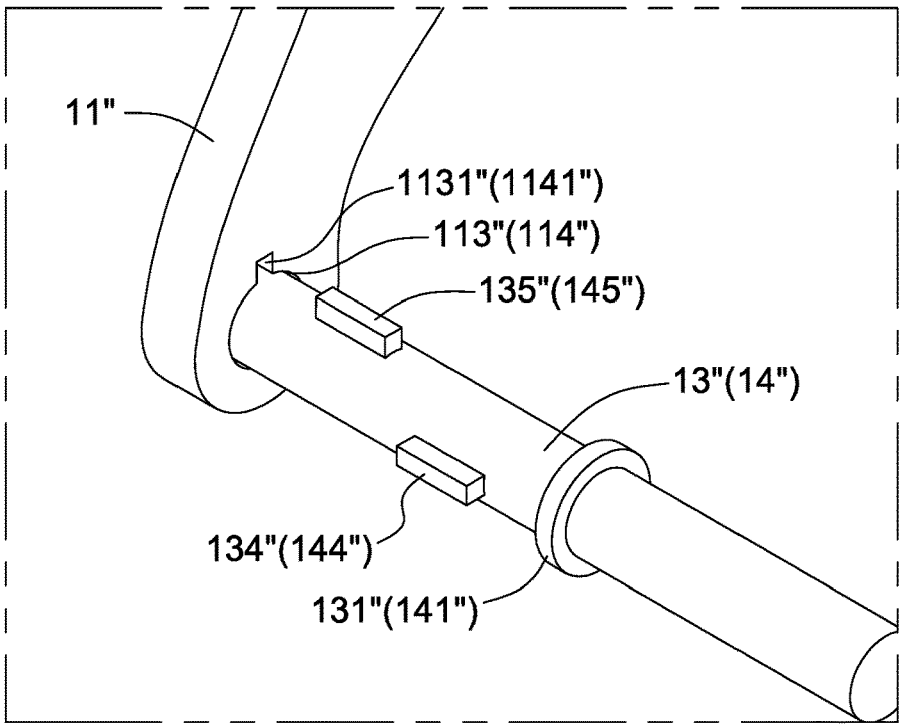
FIG. 6B is a partially enlarged view showing the lifting device in FIG. 6A.
Figure 6C:
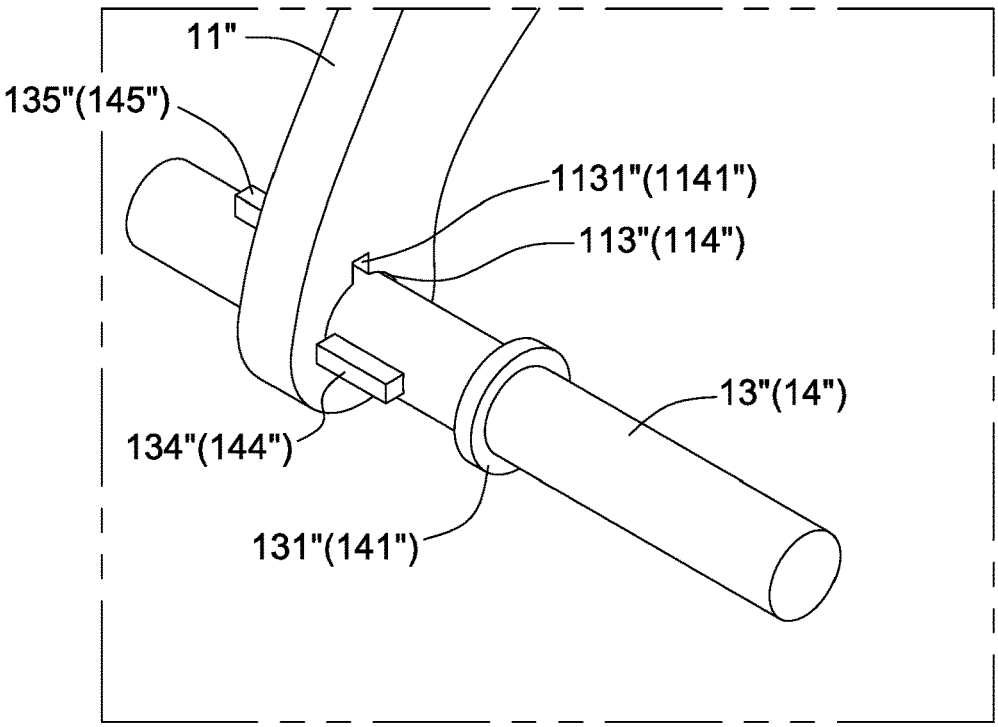
FIG. 6C is a schematic view showing a positioning element of a shaft passing through a through hole of the lifting device in accordance with the fourth embodiment of the instant disclosure.
Figure 6D:
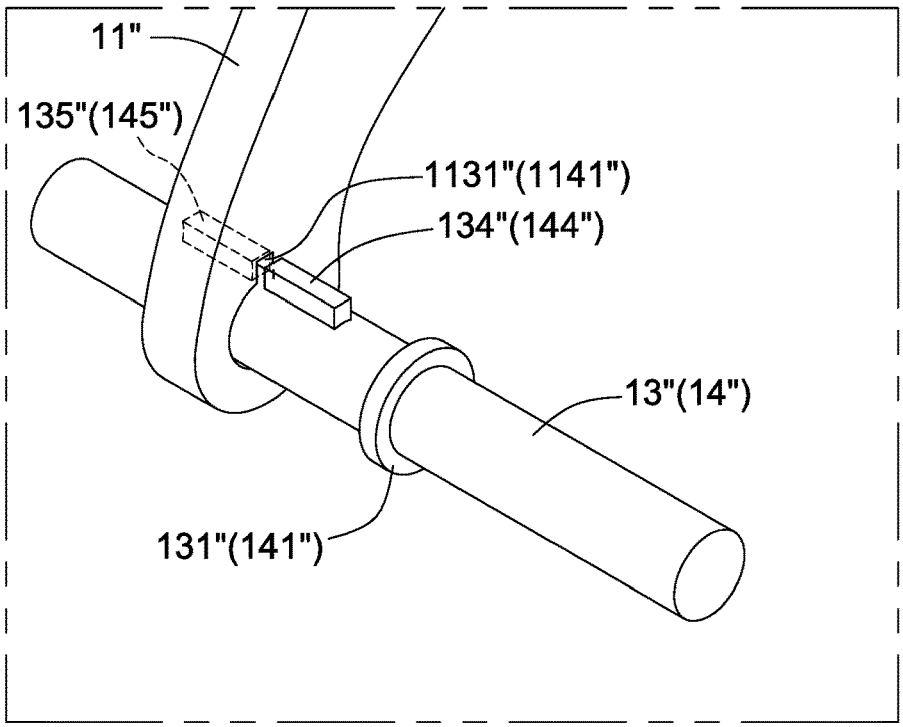
FIG. 6D is a schematic view showing another positioning element of the shaft aligned with but not passing through the through hole of the lifting device in accordance with the fourth embodiment of the instant disclosure.
Figure 6E:
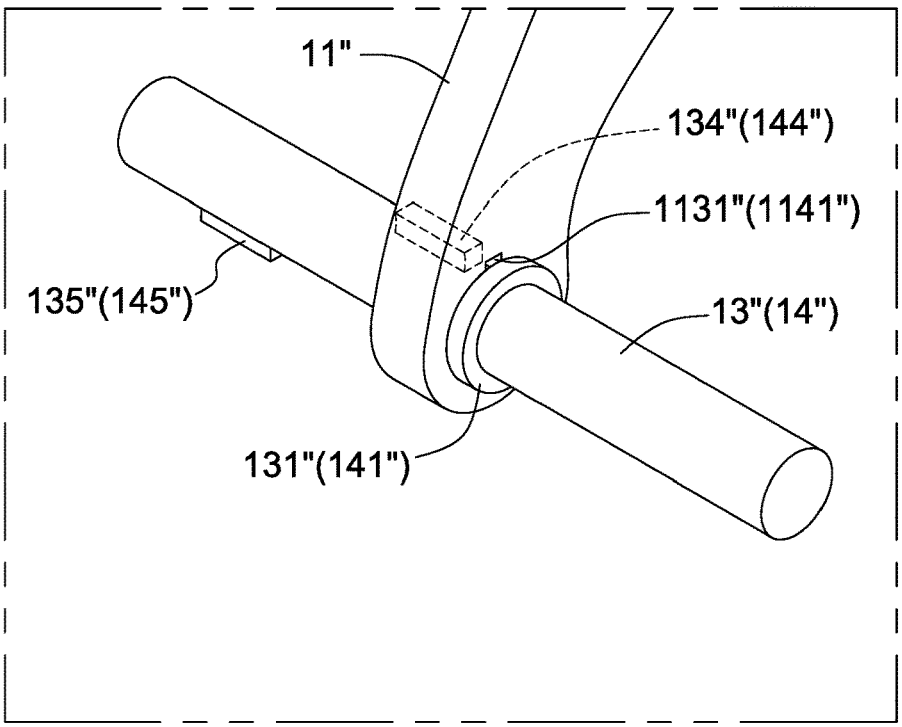
FIG. 6E is a schematic view showing both positioning elements of the shaft passing through the through hole of the lifting device in accordance with the fourth embodiment of the instant disclosure.
Figure 6F:
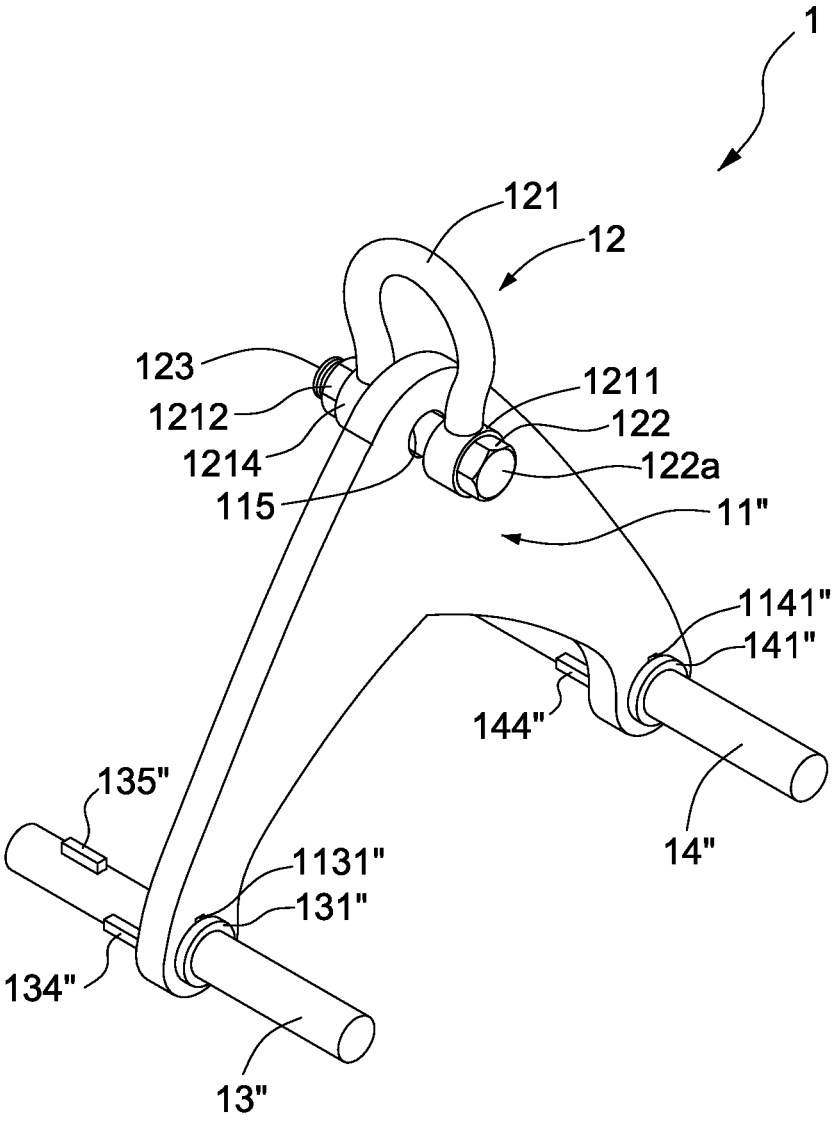
FIG. 6F is a schematic view showing the lifting device in FIG. 6A after being assembled.

In a lifting method wherein the lifting device 1 shown in FIGS. 6A and 6B is used, step (a) and step (b) are substantially the same as the corresponding ones mentioned in the previous embodiment. In step (c) of the method, during the process of providing the first shaft 13" in the first through hole 113" of the main body 11" and the second shaft 14" in the second through hole 114" of the main body 11", when the first shaft 13" is disposed in the first through hole 113" of the main body 11", the third positioning element 135" is aligned with the first positioning slot 1131" (see FIG. 6B), the third positioning element 135" passes through the first positioning slot 1131' (see FIG. 6C), the first shaft 13" is rotated such that the third positioning element 135" is not aligned with the first positioning slot 1131", and the first positioning element 134" is aligned with the first positioning slot 1131" (see FIG. 6D); after the first positioning element 134" passes through the first positioning slot 1131", the first shaft 13" is rotated such that the first positioning element 134" is not aligned with the first positioning slot 1131' and the first stop 131" of the first shaft 13" abuts against a surface of the main body 11' (see FIG. 6E). Likewise, the steps of placing the second shaft 14" in the second through hole 114" are the same as those described above for placing the first shaft 13" in the first through hole 113.' FIG. 6F shows the state that the first shaft 13" and the second shaft 14" are disposed in the first through hole 113" and the second through hole 114", respectively, and the assembly is finished. In another embodiment of the instant disclosure, the quantity of the positioning elements on the first shaft 13" and the second shaft 14" is different from that described in the previous embodiment. The quantity of the positioning elements is determined based on the requirement. For example, in an alternative embodiment, the first shaft 13" has only the first positioning element 134" thereon, and the second shaft 14" has only the second positioning element 144" thereon.

Figure 7A:
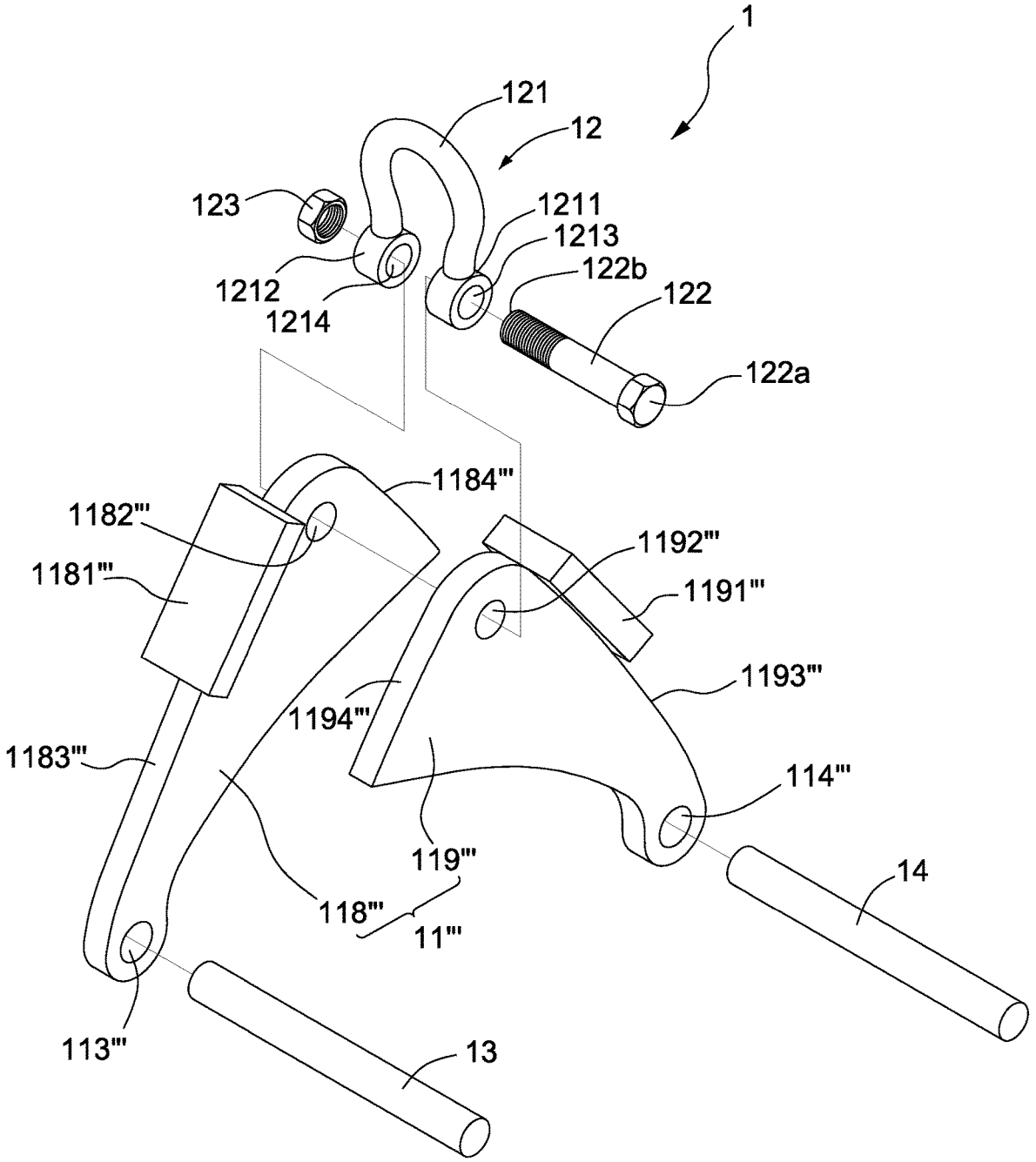
FIG. 7A is an exposed view showing a lifting device in accordance with the fifth embodiment of the instant disclosure.
Figure 7B:
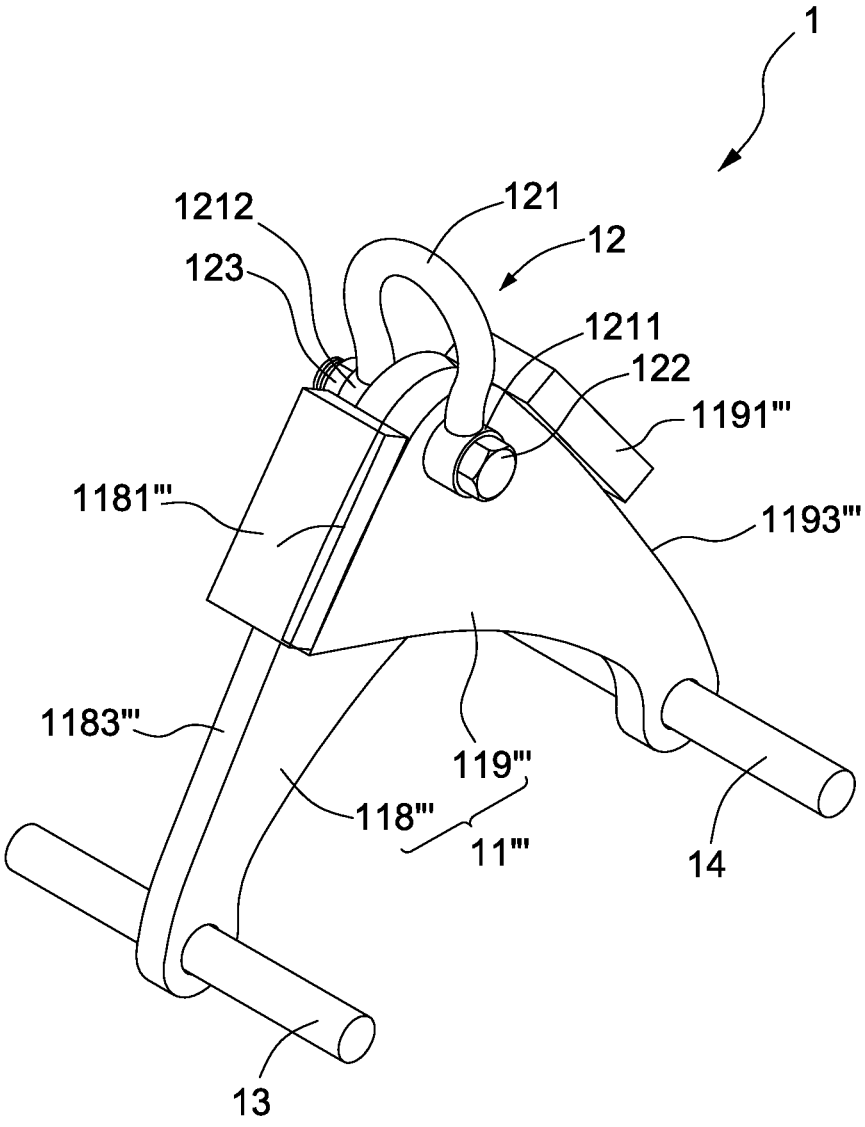
FIG. 7B is a schematic view showing the lifting device in FIG. 7A after being assembled.

Please refer to FIGS. 7A and 7B. FIG. 7A is an exposed view showing a lifting device 1 in accordance with the fifth embodiment of the instant disclosure. FIG. 7B is a schematic view showing the lifting device 1 in FIG. 7A after being assembled. The main body 11''' comprises a first arm 118''' and a second arm 119'''. The first arm 118''' comprises a first edge 1183''', a second edge 1184''', a fourth through hole 1182''' provided at a proximate end and a first through hole 113''' provided at a distal end. The first stopper 1181''' is provided on the first edge 1183''' of the first arm 118'''. The first edge 1183''' and the second edge 1184''' are connected through a first smoothly curved edge 1189'''. The length of the first edge 1183''' is larger than that of the second edge 1184'''. The second arm 119''' comprises a third edge 1193''', a fourth edge 1194''', a fifth through hole 1192''' provided at a proximate end and a second through hole 114''' provided at a distal end. The second stopper 1191''' is provided on the third edge 1193''' of the second arm 119'''. The third edge 1193''' and the fourth edge 1194''' are connected through a second smoothly curved edge 1199'''. The length of the third edge 1193''' is larger than that of the fourth edge 1194'''. The fourth through hole 1182''' and the fifth through hole 1192''' are aligned and attached to each other to form the third through hole as described in the previous embodiment such that the clasping assembly can be engaged therewith. When the supporting shaft 122 is disposed in the through holes 1213, 1214 of the buckle 121, the fourth through hole 1182''' of the first arm 118''' and the fifth through hole 1192''' of the second main body 119''' are pivotable in relation to the supporting shaft 122, the second edge 1184''' of the first arm 118''' abuts against an inner surface of the second stopper 1191''' of the second arm 119''', and the fourth edge 1194''' of the second arm 119''' abuts against an inner surface of the first stopper 1181''' of the first arm 118'''. In another embodiment of the instant disclosure, after the clasping assembly 12 is engaged with the fourth through hole 1182''' of the first arm 118''' and the fifth through hole 1192''' of the second arm 119''', the first shaft 13 is disposed in the first through hole 113''' of the first arm 118''' of the main body 11''', and the second shaft 14 is disposed in the second through hole 114''' of the second arm 119''' of the main body 11'''. In another embodiment of the instant disclosure, the first shaft 13' and the second shaft 14' described in the previous third embodiment is provided, the first positioning slot 1131'' and the second positioning slot 1141'' described in the previous fourth embodiment adjacent the first through hole 113''' of the first arm 118''' of the main body 11''' and the second through hole 114''' of the second arm 119''' of the main body 11''', respectively, and are provided for allowing the first shaft 13'' and the second shaft 14'' to pass through. Moreover, in another embodiment of the instant disclosure, before the step of engaging the clasping assembly 12 with the fourth through hole 1182''' of the first arm 118''' of the main body 11''' and the fifth through hole 1192''' of the second arm 119''' of the main body 11''', the first shaft 13 is inserted into the first through hole 113''' of the first arm 118''' of the main body 11''' and the second shaft 14 is inserted into the second through hole 114''' of the second arm 119'''.

The terminology used in the description of the present disclosure is for the purpose of describing particular embodiments only, and is not intended to limit the disclosure. As used in the description of the disclosure and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items.

It shall be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. The use of directional adjectives "above, "under," "upper," "lower," "below," "left," "right," "up," "down," "top," "bottom," "vertical," "horizontal," and like terms, are meant to assist with understanding relative relationships among design elements and should not be construed as meaning an absolute direction in space nor regarded as limiting. For example, in some embodiments, "a first component is on a second component" describes the first component being on the second component (the first component is directly on the second component), while some other components are between the first and second components.

Terms such as "approximately," "substantially," or "about" are applied to describe a small variation of a structural unit of an apparatus. When a term is used in conjunction with another term to describe a particular characteristic of the claimed disclosure, such term can indicate the exact events or circumstances, and similar exact events or circumstances.

Obviously, numerous modifications and variations of the present disclosure are possible in light of the above teachings. It is therefore to be understood that within the scope of the appended claims, the present disclosure may be practiced otherwise than as specifically described herein.

What is claimed is:

1. A lifting device for lifting a semi-precast beam, the semi-precast beam having a plurality of loop-shaped stirrups with a predetermined distance therebetween or a spiral-shaped stirrup disposed along the lengthwise direction of the semi-precast beam, the device comprising:

a main body, comprising a first through hole, a second through hole and a third through hole therein, wherein an axis passes through the third through hole, and the first through hole and the second through hole are symmetrically arranged with respect to the axis;

a clasping assembly, comprising a closed-loop structure configured to be engaged with the third through hole;

a first shaft, being adapted to be inserted into the first through hole of the main body; and a second shaft, being adapted to be inserted into the second through hole of the main body;

where the lifting device is in use, the first shaft and the second shaft abut against inner surfaces of at least some of the plurality of loop-shaped stirrups or inner surfaces of the spiral-shaped stirrup of the semi-precast beam;

wherein the closed-loop structure of the clasping assembly comprises a generally U-shaped buckle with two ends and a supporting shaft, each of the two ends of the buckle having a through hole therein, the supporting shaft being adapted to be disposed in the third through hole of the main body and each through hole of the two ends of the buckle;

wherein the first shaft has a first positioning element thereon and the second shaft has a second positioning element thereon, wherein the main body has a first positioning slot therein for allowing the first positioning element to pass through, and a second positioning slot therein for allowing the second positioning element to pass through, the first positioning slot being adjacent the first through hole, the second positioning slot being adjacent the second through hole;

wherein the first shaft has a first stop thereon and the second shaft has a second stop thereon; when the first shaft is disposed in the first through hole and the second shaft is disposed in the second through hole, the first positioning element and the second positioning element are located at a first side of the main body, and the first stop and the second stop are located at a second side of the main body, the first side being opposite the second side in relation to the main body; and wherein the first shaft further has a third positioning element thereon and the second shaft has a fourth positioning element thereon, the third positioning element is not aligned with the first positioning element along the axial direction of the first shaft, and the fourth positioning element is not aligned with the second positioning element along the axial direction of the second shaft, wherein the first positioning element, the second positioning element, the third positioning element and the fourth positioning element are all located at the first side of the main body.

2. The device of claim 1, wherein the main body comprises a first arm and a second arm extending outward from the axis, wherein the first through hole and the second through hole are disposed in the first arm and the second arm, respectively.

3. The device of claim 1, wherein the first shaft has a first stop thereon abutting against the main body, a first pin hole therein, and a first pin being adapted to be disposed in the first pin hole, and the second shaft has a second stop thereon abutting against the main body, a second pin hole therein, and a second pin being adapted to be disposed in the second pin hole, wherein the first pin and the second pin are disposed at a first side of the main body, and the first stop and the second stop are disposed at a second side of the main body, the first side being opposite the second side in relation to the main body.

4. The device of claim 3, wherein the main body is provided with a plurality of the first through holes for selectively receiving the first shaft and a plurality of the second through holes for selectively receiving the second shaft, wherein the plurality of the first through holes are aligned with the plurality of the second through holes, and the third through hole is not aligned with the plurality of the first through holes or the plurality of the second through holes.

5. A lifting device comprising:

a main body, comprising a first arm and a second arm extending outward from an axis, the first arm having a first through hole therein, the second arm having a second through hole therein, the main body further comprising a third through hole therein, wherein the axis passes through the third through hole, and the first through hole and the second through hole are symmetrically arranged with respect to the axis;

a clasping assembly, comprising a closed-loop structure configured to be engaged with the third through hole;

a first shaft, being adapted to be inserted into the first through hole of the main body; and a second shaft, being adapted to be inserted into the second through hole of the main body;

wherein the closed-loop structure of the clasping assembly comprises a generally U-shaped buckle with two ends and a supporting shaft, each of the two ends of the buckle having a through hole therein, the supporting shaft being adapted to be disposed in the third through hole of the main body and each through hole of the two ends of the buckle;

wherein the first arm is integrally formed with the second arm and the first shaft has a first positioning element thereon and the second shaft has a second positioning element thereon, wherein the main body has a first positioning slot therein for allowing the first positioning element to pass through, and a second positioning slot therein for allowing the second positioning element to pass through, the first positioning slot being adjacent the first through hole, the second positioning slot being adjacent the second through hole;

wherein in operation the first through hole and the second through hole are substantially at the same height and lower than the third through hole;

wherein the first shaft has a first stop thereon and the second shaft has a second stop thereon; when the first shaft is disposed in the first through hole and the second shaft is disposed in the second through hole, the first positioning element and the second positioning element are located at a first side of the main body, and the first stop and the second stop are located a second side of the main body, the first side being opposite the second side in relation to the main body; and wherein the first shaft further has a third positioning element thereon and the second shaft has a fourth positioning element thereon, the third positioning element is not aligned with the first positioning element along the axial direction of the first shaft, and the fourth positioning element is not aligned with the second positioning element along the axial direction of the second shaft, wherein the first positioning element, the second positioning element, the third positioning element and the fourth positioning element are all located at the first side of the main body, and wherein the first stop is ring-shaped and surrounds the first shaft and the second stop is ring-shaped and surrounds the shaft.

6. The device of claim 5, wherein the first arm has a first edge having a first stopper thereon, a second edge and a fourth through hole therein provided at a proximate end of the first arm, the first edge and the second edge being connected through a first smoothly curved edge, wherein the second arm has a third edge having a second stopper thereon, a fourth edge and a fifth through hole therein provided at a proximate end of the second arm, the third edge and the fourth edge being connected through a second smoothly curved edge, wherein the fourth through hole of the first arm and the fifth through hole of the second arm are aligned to form the third through hole.

7. The device of claim 6, wherein the second edge of the first arm faces toward the fourth edge of the second arm, and wherein the first arm and the second arm are pivotable in relation to the supporting shaft and when the device is in use, the second edge of the first arm abuts against an inner surface of the second stopper of the second arm and the fourth edge of the second arm abuts against an inner surface of the first stopper of the first arm.

8. The device of claim 5, wherein the first shaft has a first stop thereon abutting against the main body, a first pin hole therein, and a first pin being adapted to be disposed in the first pin hole and the second shaft has a second stop thereon abutting against the main body, a second pin hole therein, and a second pin being adapted to be disposed in the second pin hole wherein the first pin and the second pin are disposed at a first side of the main body and the first stop and the second stop are disposed at a second side of the main body, the first side being opposite the second side, and wherein the first stop is ring-shaped and surrounds the first shaft and the second stop is ring-shaped and surrounds the shaft.

9. The device of claim 5, wherein the main body is provided with a plurality of the first through holes for selectively receiving the first shaft and a plurality of the second through holes for selectively receiving the second shaft, wherein the plurality of the first through holes are aligned with the plurality of the second through holes and the third through hole is not aligned with the plurality of the first through holes or the plurality of the second through holes.

10. A lifting method comprising the steps of:

providing a semi-precast beam having a plurality of loop-shaped stirrups with a predetermined distance therebetween or a spiral-shaped stirrup disposed along the lengthwise direction of the semi-precast beam;

providing a lifting device of claim 5;

moving the lifting device near the exposed portion of the stirrups such that the first through hole and the second through hole of the main body are slightly lower than the tops of the stirrups;

providing the first shaft in the first through hole of the main body and the second shaft in the second through hole of the main body such that the first shaft and the second shaft are within the stirrups; and lifting the device such that the circumferences of the first shaft and the second shaft abut against inner surfaces of at least some of the stirrups.

11. The method of claim 10 wherein the step of providing the first shaft in the first through hole of the main body and the second shaft in the second through hole of the main body comprises:

aligning the first positioning element with the first positioning slot and passing the first positioning element through the first positioning slot;

rotating the first shaft such that the first positioning slot is not aligned with the first positioning slot;

moving the first shaft along its axial direction such that the first stop abuts against the main body;

aligning the second positioning element with the second positioning slot and passing the second positioning element through the second positioning slot;

rotating the second shaft such that the second positioning slot is not aligned with the first positioning slot; and moving the second shaft along its axial direction such that the second stop abuts against the main body.

* * * * *